United States Patent [19]

Brown

[11] Patent Number: 4,784,105

[45] Date of Patent: Nov. 15, 1988

[54] HIGH PERFORMANCE DIGITAL IGNITION SYSTEM FOR INTERNAL COMBUSTION ENGINES

[76] Inventor: Craig R. Brown, 1417 E. Cheryl Dr., Phoenix, Ariz. 85020

[21] Appl. No.: 29,145

[22] Filed: Mar. 23, 1987

Related U.S. Application Data

[63] Continuation of Ser. No. 850,594, Apr. 11, 1986, Pat. No. 4,686,954.

[51] Int. Cl.[4] ..... F02P 7/077; F02P 15/10

[52] U.S. Cl. ..... 123/607; 123/613; 123/617; 123/637

[58] Field of Search ..... 123/606, 607, 617, 613, 123/637

[56] References Cited

U.S. PATENT DOCUMENTS

| | | | |
|---|---|---|---|
| 2,548,056 | 4/1951 | Powasnick | 123/640 X |
| 3,906,919 | 9/1975 | Asik | 123/606 |
| 3,926,557 | 12/1975 | Callies et al. | 123/606 |
| 3,934,570 | 1/1976 | Asik et al. | 123/598 |
| 3,945,362 | 3/1976 | Newman et al. | 123/606 |
| 3,976,044 | 8/1976 | Madeira et al. | 123/617 |
| 4,022,177 | 5/1977 | Canup | 123/606 |
| 4,181,112 | 1/1980 | Grather et al. | 123/606 |
| 4,192,275 | 3/1980 | Weydemuller | 123/607 |
| 4,208,992 | 6/1980 | Polo | 123/415 |
| 4,228,778 | 10/1980 | Rabus et al. | 123/605 |
| 4,245,594 | 1/1981 | Morino | 123/606 |
| 4,328,771 | 5/1982 | Karvai et al. | 123/179 BG |
| 4,359,998 | 11/1982 | Topic | 123/606 |
| 4,417,563 | 11/1983 | Brodie | 123/606 |

*Primary Examiner*—Willis R. Wolfe

*Attorney, Agent, or Firm*—James H. Phillips

[57] ABSTRACT

A very high performance digital ignition system is disclosed which includes a precision angular position sensor within the distributor of an internal combustion engine (or otherwise coupled to the engine to sense its angular position) to provide accurate timing information which is applied to gating means for selectively passing bursts of triggering pulses having, in the exemplary embodiment, a 7-to-1 duty cycle ratio. The selected burst of pulses are applied to a driver circuit which provides power amplification to energize the primary circuit of an ignition coil. An alternative mode of operation is also disclosed which simulates a conventional make and break ignition system to effect a service mode. In the service mode of operation, a single pulse is issued to the ignition coil upon the occurrence of the first or second pulse of the pulse burst after the angular position sensor has sensed that a cylinder firing operation should be instituted. As a result, ordinary timing and diagnostic instruments may be used during the service mode of operation to very accurately establish the ignition timing during normal, burst mode operation.

4 Claims, 2 Drawing Sheets

HIGH PERFORMANCE DIGITAL IGNITION SYSTEM FOR INTERNAL COMBUSTION ENGINES

CROSS REFERENCE TO RELATED APPLICATION

This application is a continuation of United States patent application Ser. No. 850,594, filed Apr. 11, 1986, also entitled "HIGH PERFORMANCE DIGITAL IGNITION SYSTEM FOR INTERNAL COMBUSTION ENGINES" by Craig R. Brown and also assigned to the same Assignee as this application, now U.S. Pat. No. 4,686,954.

FIELD OF THE INVENTION

This invention relates to the internal combustion engine arts and, more particularly, to the field of spark ignition systems for such engines.

BACKGROUND OF THE INVENTION

Traditionally, internal combustion engine ignition systems have used either a magneto or, more commonly, a distributor/ignition coil system for developing and distributing, on a timely basis, high voltage electrical energy to the spark plugs which serve to ignite a fuel mixture charge in each cylinder at or near the beginning of a cylinder power stroke. In the past, most distributor/coil ignition systems have employed mechanical points whose contacts are broken periodically in order to permit the collapse of the magnetic field in the ignition coil primary winding to generate, at the nominally correct instant, the high voltage potential in the ignition coil secondary. Distribution of the high voltage potential has been conventionally performed by a rotor in the distributor housing which rotates to sequentially address peripherally distributed electrodes in a distributor cap which are, in turn, connected to the individual spark plug wires. More recently, diverse systems have been developed to eliminate the breaker points and substitute therefore an electromagnetic or electro-optical sensor assembly connected to a low level amplifier to effect an electronic switch.

As a result of a sense of conservation caused by the notorious energy crisis which developed in the early 1970's in conjunction with heightened sensibilities to the deleterious effects of environmental pollutants issued by internal combustion engine powered vehicles, significant efforts have been directed in recent years to both improving the efficiency of vehicle internal combustion engines and controlling the issuance of pollutants from them. Attention has been given to more closely controlling the instantaneous fuel-to-air mixture, to treatment of the exhaust gas (as by the use of catalytic converters) and to more closely controlling the instant of spark plug firing according to sensed instantaneous engine speed and load conditions. However, one difficulty which remains as a source of both engine inefficiency and the discharge of pollutants is the incomplete combustion which results from the fact that conventional ignition systems cause the spark plugs to arc for only a very brief period during the combustion process in a given cylinder, principally to simply initiate the combustion process.

As previously mentioned, great care is taken to insure that the precise instant at which spark plug arcing begins is optimum for the given conditions present, although truly optimal timing is rarely achieved. However, it has been recognized that, if the spark plug for a given cylinder can be made to continue arcing throughout the power stroke of the cylinder, much more complete combustion results with a consequent reduction in air pollution, increase in engine power and increase in fuel mileage and which also permits the elimination of some or all of such devices as the E.G.R. valve, A.I.R. pump, temperature delayed spark, ultralean fuel mixture carburetors, catalytic converters and the like.

One prior art system in which the advantages of maintaining the spark plug arc throughout the power stroke of a cylinder was recognized is disclosed in U.S. Pat. No. 4,417,563 to Brodie. Brodie discloses a nearly completely electronic spark development system including a high frequency oscillator, a step up transformer and a voltage multiplier to obtain the requisite high voltage without an ignition coil. Brodie's high voltage, because of its manner of development, is a-c and is maintained continuously. Only the position of the rotor as it sweeps across the peripherally distributed electrodes of the distributor cap serves to effect the timing, the high voltage itself being present continuously.

While Brodie has achieved a valuable contribution to the art, there are nonetheless drawbacks to his system in some internal combustion environments. With respect to retrofitting existing internal combustion engines, Brodie dispenses with the ignition coil which, as previously mentioned, is not required in his system. However, the replacement cost is substantial. Therefore, it will be appreciated by those skilled in the art that it would be useful to provide a more readily retrofitted system which incorporates the existing coil of an internal combustion engine, but which nonetheless enjoys the technical advantage of maintaining the spark plug arc throughout the power stroke of a cylinder. Achieving accurate and reliable timing with Brodie's system is somewhat uncertain because of his reliance on the mechanical position of the rotor to determine when the high voltage will be sent to a given electrode connected to a given spark plug rather than by precisely monitoring the angular position of the distributor shaft. Thus, those skilled in the art will appreciate that it would be highly desirable to provide a system which, like Brodie's system, affords spark plug arcing throughout a cylinder's power stroke, but in which the onset of the arcing is carefully controlled, and which can be readily incorporated into existing or new internal combustion engines. The present invention is directed to such ends.

OBJECTS OF THE INVENTION

It is therefore a broad object of my invention to provide an improved ignition system for an internal combustion engine.

It is another object of my invention to provide an ignition system for an internal combustion engine which provides an essentially continuous delivery of high voltage bursts to the spark plug of a cylinder during its power stroke.

It is yet another object of my invention to provide such an ignition system which is economical to fabricate, reliable in long term operation and which can be readily incorporated into existing or new internal combustion engines.

SUMMARY OF THE INVENTION

Briefly, these and other objects of the invention are achieved by providing a free running square wave oscillator driving a divide-by-eight circuit which issues a pulse string at about 925 hertz (using conventional coils) and having a seven-to-one duty cycle ratio. The pulse string is selectively applied to a driver circuit which provides power amplification to energize the primary circuit of a conventional ignition coil. An angular position sensor within the distributor of an internal combustion engine provides timing information which is applied to gating means for selectively passing the 925 hertz signal to the coil driver. Preferably, the angular sensing means within the distributor is a light source/-light sensor unit cooperating with a rotating shutter assembly alternately making and breaking the light beam in accordance with the angular position of the distributor shaft. Switch means are provided to additionally permit the continuous development of high voltage to the distribution system to emulate the Brodie system and also to simulate a conventional make and break ignition system to effect a service mode.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DETAILED DESCRIPTION OF THE INVENTION

Figure 1:
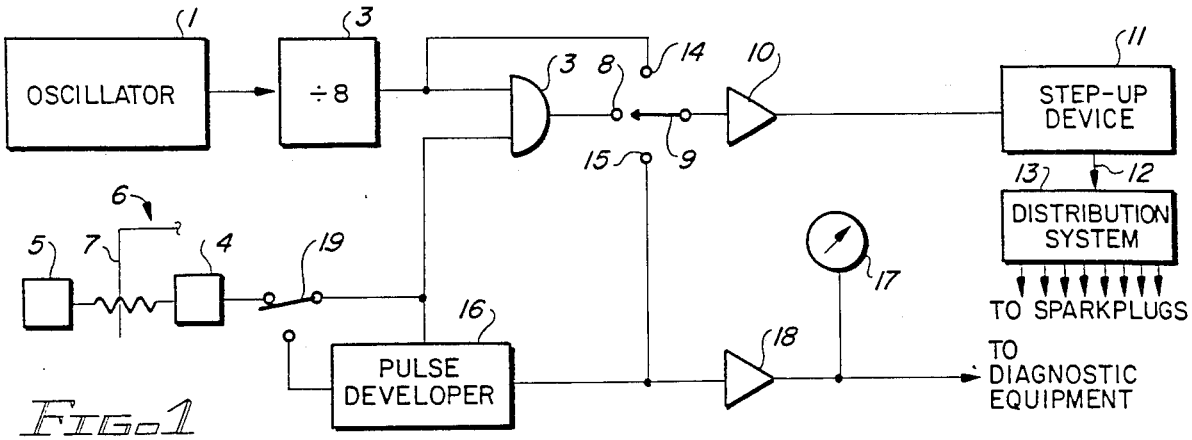
FIG. 1 is a high level functional block diagram of my ignition system.
Figure 2:
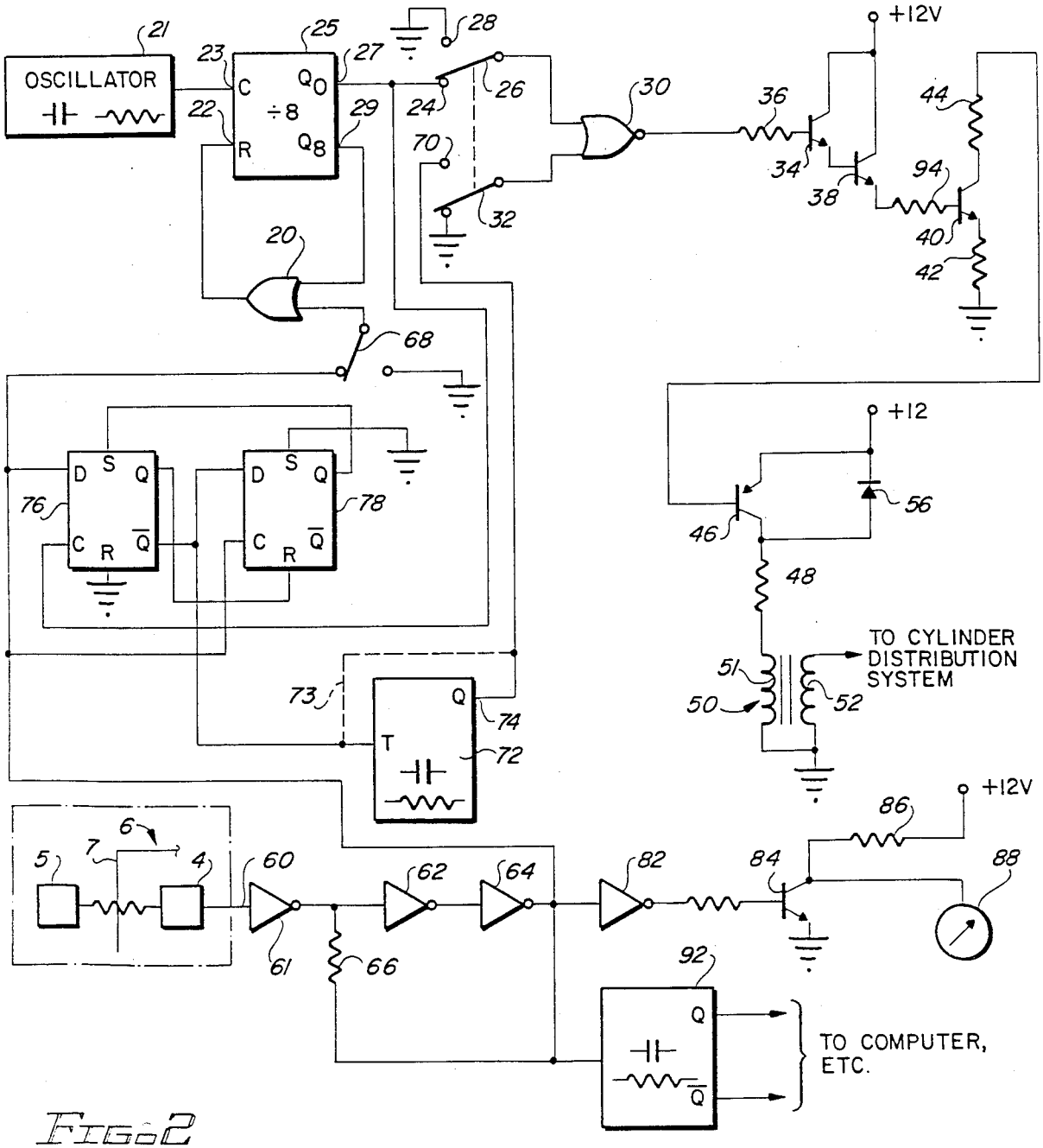
FIG. 2 is a more detailed block/schematic diagram of a presently preferred embodiment of the subject ignition system.

The basic concepts of the subject ignition system may best be appreciated with initial reference to the simplified representation shown in FIG. 1. A self starting square wave oscillator 1 is configured such that its free running frequency is about 7600 hertz. The output of the oscillator 1 is applied to the input to a divide-by-eight circuit 2. The divide-by-eight circuit 2 is configured to, in effect, pass every eighth pulse issued by the square wave oscillator 1; hence, it will be appreciated that the output of the divide-by-eight circuit 2 has a logic "0" (or "low") to logic "1" (or "high") duty cycle of seven-to-one and constitutes a continuous stream of such pulses. The output of the divide-by-eight circuit 2 is applied as one input to an AND-gate 3 which, as will become more apparent from the description of the presently preferred embodiment shown in FIG. 2, is merely representative of the circuit function. The other input to AND-gate 3 receives timely enabling pulses from the output of a light sensor 4 which correspondingly intermittently receives light from a light source 5 according to the position of a shutter 6. Light sensor 4, light source 5 and shutter 6 are disposed within a conventional internal combustion engine distributor and serve a function similar to conventional points in that, as will be described more fully below, they cooperate to precisely establish the onset of groups of pulses periodically issued to the engine spark plugs. Shutter 6 has a lip 7 which alternatively passes and blocks off the light path between the source 5 and the sensor 4 as the distributor shaft rotates. A more complete description of this assembly is set forth below.

Thus, as intermittent pulses are issued by the light sensor 4, the AND-gate 3 is selectively enabled to pass the pulse stream output from the divide-by-eight circuit 2 to a normally closed terminal 8 of a switch 9. As a result, bursts of the pulses issued by the divide-by-eight circuit 2 are applied to the input of a power amplifier 10 which drives a step up device 11. The step up device 11, in the presently preferred embodiment of the invention, is simply a conventional ignition coil having low voltage primary and high voltage secondary windings.

As previously mentioned, the pulses applied to the amplifier 10 are such as to provide seven units of time "high" followed by one unit of time "low" at the output of the power amplifier 10. Thus, the step-up device 11 has current passing through its primary winding for $\frac{7}{8}$ths of each firing cycle to develop full saturation before the current is cut off for the eighth unit of time in order to permit the magnetic field to collapse and issue a high voltage pulse from the secondary winding at the high voltage output line 12. The high voltage pulses appearing at the output line 12 are distributed to the engine spark plugs by a distribution system 13 which may simply be the conventional rotor and cap also being rotated within the engine distributor by the distributor shaft. Alternatively, the distribution system 13 may constitute an electronic distribution system to eliminate the need for a conventional distributor, the timing, in that event, being obtained from a system similar to the distributor timing system, but in some other manner related to instantaneous engine position.

In the event that it is desired to obtain a continuous stream of high voltage pulses at the 925 hertz rate and rely upon the distribution system 13 to effect the timing in a manner similar to that disclosed by the previously mentioned Brodie reference, the switch 9 may be thrown to its first alternative position at the normally open terminal 14. When the switch 9 is in this position, the AND-gate 3 is simply bypassed to provide the continuous stream of asymmetrical duty cycle pulses to the power amplifier 10.

Some ignition timing devices and other diagnostic and alignment equipment currently available are not capable of following the pulse bursts which are characteristic of the subject ignition system in its normal operation mode. In order to permit the use of such devices to precisely establish and set the engine timing and to perform other diagnostic and alignment tasks, the facility for switching to a service mode of operation is provided. In the service mode of operation (in which it is desired to operate essentially as a conventional ignition system so that conventional timing methods, such as timing lights, scopes, etc. can be used), the switch 9 is thrown to its second alternative position to connect the input of the amplifier 10 to normally open terminal 15, and the switch 19 is thrown to its alternative position in which the timing pulse output from the light sensor 4 is redirected to a pulse developer circuit 16. Pulse developer circuit 16 serves to develop a single "low" pulse of the correct timing and length from each pulse issued by the light sensor 4, the output from pulse developer circuit remaining "high" between successive "low" pulses. This "low" pulse, which in effect corresponds to the breaking points in a conventional make and break ignition system and also accurately represents the start of the normal mode (gated bursts) operation, is applied to the power amplifier 10 which abruptly stops the drive to the step up device 11 as previously described. The pulse from the pulse developer 16 may also be employed to drive an isolation amplifier 18 to which a conventional tachometer 17 and other diagnostic and alignment equipment may be connected.

Referring now to the more detailed schematic block diagram shown in FIG. 2, a self-starting square wave oscillator 21 (e.g., a Motorola MC14007) is provided with suitable timing components to obtain a free running frequency of about 7600 hertz. The square wave output of the oscillator 21 is applied to an input 23 of a digital frequency divider 25 having several outputs, among them $Q_0$ output 27 and $Q_8$ output 29. The digital frequency divider 25, which essentially serves to establish the desired ratio between the "high" and "low" states in the pulse stream, may comprise a Motorola MC14017 programmable decade counter which has been programmed to selectively perform the divideby-eight function by providing a controllable feedback path between its $Q_8$ output and its reset input 22. That is, the $Q_8$ output 29 of frequency divider 25 is applied to a first input of an OR-gate 20 such that, if it is assumed that the second input of OR-gate 20 is at a logic "low" level, a "high" pulse appearing at output 29 will be applied to the "reset" input 22 to prepare the frequency divider 25 to count the next series of eight pulses appearing at its input 23. Thus, complimentary output poles appear at outputs 27 and 29, one for each eight input pulses to provide an output frequency (which is appropriate for conventional ignition coils) of approximately 925 hertz, and the "high" to "low" and "low" to "high" duty cycle ratios at these respective points are seven-to-one.

The $Q_0$ output 27 of frequency divider 25 is applied to a first terminal 24 of a switch 26. The other terminal 28 of switch 26 is connected to ground (i.e., to logic "low"). Terminal 24 of switch 26 is the normally closed position while terminal 28 is normally open and, when closed, enables the service mode previously mentioned and to be described further below. When switch 26 is coupled to terminal 24 for normal operation, the pulse stream at the $Q_0$ output 27 from frequency divider 25 is coupled to a first input of a NOR gate 30, the second input of which is normally grounded (i.e., maintained at logic "low") via switch 32. Thus, the pulse stream is inverted by NOR gate 30, and the resulting signal is applied through an isolation resistor 36 to the base electrode of an NPN transistor 34.

Transistors 34 and 38 (which may be, e.g., type 2N2222) are connected in a Darlington pair configuration (with their collector electrodes connected to +12 volts d-c) to form a high-gain current amplifier, the output of which is coupled to the base electrode of an NPN driver transistor 40 (which may be a type 2N3055).

The driver transistor 40 has its emitter electrode coupled to ground via resistor 42, and its collector electrode is coupled, via isolation resistor 44, to the base electrode of a PNP power switching transistor 46 which may be a Motorola type MJ2955. The collector electrode of power transistor 46 is coupled via a current limiting resistor 48 to the primary winding 51 of an ignition coil 50. The emitter electrode of power transistor 46 is connected to a +12 volt d-c source, and power transistor 46 is shunted by a diode 56 to protect the transistor from back E.M.F. which occurs when the current flowing through the coil primary 51 is abruptly interrupted. As those skilled in the art will understand, during each period when power transistor 46 is conducting, current passes through the coil primary 51, and a magnetic field builds up. When the power transistor 46 is switched off to interrupt the current flow, the magnetic field suddenly collapses to induce a high voltage pulse into the secondary winding 52 of the coil 50, and the high voltage pulse is communicated to a spark plug by the high voltage distribution system.

A light sensor 4 and a light source 5 are employed to obtain fundamental ignition timing information in accordance with the angular position of the engine as it rotates and are situated in a position indicating device such as a distributor. When the light sensor 5 receives light from the source 4 (which occurs when a segmented shutter 6 does not present a lip segment across the light path), a "low" signal is generated by the sensor 4 whose output 60 is coupled to and amplified by a low level amplifier 61 which drives a Schmitt-trigger comprising series coupled inverters 62 and 64. In the conventional fashion, a resistor 66 is cross coupled between the input to inverter 62 and the output of inverter 64 providing a certain amount of hysteresis which improves rise and fall times. Inverters 62 and 64 may comprise a pair of sections of a Motorola MC14007. Thus, when the sensor output 60 is switching, much faster and cleaner transitions between "low" and "high" appear at the output of inverter 64. This signal is applied to the second input of OR-gate 20, and, as a result, during periods in which the output of inverter 64 is "low", the pulses appearing at the $Q_8$ output 29 of divider 25 pass through OR-gate 20 to the reset input 22, thus permitting the divider 25 to continuously divide the incoming signal by eight as previously described. However, grounding a second input of OR-gate 20 by actuating switch 68 will cause divider 25 to completely ignor the output of the light sensor 4 and run free at all times. The function of switch 68 will be discussed further below.

When a lip segment 7 of the segmented shutter 6 blocks the light path between light source 5 and light sensor 4, a "high" output will appear at the sensor output 60 and therefore also at the output of inverter 64, thus disabling OR-gate 20 and stopping the pulse streams from issuing from the outputs 27, 29 of frequency divider 25. It will therefore be understood that as long as the output of light sensor 4 is "low", a stream of pulses is applied to the ignition coil 50, and the coil is energized for seven/eighths of the period between individual cutoff pulse transitions (and also between each group of pulses) to permit building maximum flux in the primary winding 51, thereby assuring an accurately timed spark at the instant each individual cutoff transition occurs. When the output of light sensor 4 goes "high", as during the period after the completion of a power stroke in one cylinder and before the beginning of the power stroke of the next cylinder to fire, no pulses are applied to the ignition coil 50 which therefore prevents the premature onset of ignition of the next cylinder in the firing order.

As previously mentioned, provision is made for operation in a service mode in which single pulse "breaker point" operation is emulated. In the service mode, switches 26 and 28 are thrown to their alternate position such that switch 26 is coupled to terminal 28 and switch 32 is coupled to terminal 70. Switches 26 and 32 may be ganged as shown in FIG. 2 for convenience.

In the service mode configuration, a programmable monostable flipflop 72 (which may be a Motorola type MC14528) may optionally be utilized to generate a firing pulse of predetermined width (by selecting appropriate RC components) at its Q output 74 in response to a sensed transition from "high" to "low" by the light sensor 4. The firing pulse is applied via terminal 70 of switch 32 to NOR-gate 30 and thence to the remainder of the circuitry beyond NOR-gate 30 as previously described. If a firing pulse of precise width is not desired in the service mode of operation, the flipflop 72 may be eliminated as indicated by the dashed line 73.

Whether or not the optional flipflop 72 is present, the single pulse is developed as follows. The $Q_0$ output 27 of the frequency divider 25 is applied to the clock input of a first D-type flipflop 76. The D input of flipflop 76 and the clock input of a second D-type flipflop 78 are coupled to receive the output of inverter 64. The Q output of flipflop 76 is coupled to the reset input of flipflop 78, and the reset input of flipflop 76 and the set input to flipflop 78 are grounded to hold them at logic "low". (The D-type flipflops 76 and 78 may be Motorola type MC14013 or equivalent.) The Q bar output of flipflop 76 is coupled to the D input of flipflop 78 and also to the trigger input of monostable flipflop 72 if provided or is connected directly to the terminal 70 of switch 32 if the flipflop 72 is eliminated. The Q output of flipflop 78 is coupled to the set input of flipflop 76.

Consider now the following operation. If it is first assumed that a lip segment 7 of the segmented shutter 6 blocks the light path between light source 5 and light sensor 4 and that flipflop 76 is set (as it must be by the second cycle of operation) then the output 60 of light sensor 4 is "low" (a characteristic of the selected device which may be a Texas Instruments TIL-145), and the output of inverter amplifier 61 is "high". Therefore, the output of inverter 64 is also high, OR-gate 20 is disabled, the $Q_0$ output 27 of frequency divider 25 is low, the Q output of flipflop 76 is "high" (i.e., flipflop 76 holds a logic "1"), and flipflop 78 is reset.

Thus, flipflops 76 and 78 remain in this set state, until OR-gate 20 is again enabled by the next "high"-to-"low" transition at the output of inverter 64 (i.e., "low"-to-"high" transition at the output of light sensor 4) which is applied to the data (D) input of flipflop 76.

The "high"-to-"low" transition of the output of inverter 64 enables the OR-gate 20 to allow the reset input to divider 25 to switch to the active mode, thereby causing divider 25 to issue its pulses at output 27; and the first "low"-to-"high" transition of the $Q_0$ output 27 serves as a valid clock pulse for flipflop 76. The "low"-to-"high" clock pulse allows the transfer of the "low" on the date (D) input to the Q output, and thus the Q bar output issues a "high"-to-"low" transition. This signal is coupled to terminal 70 on switch 32, and the result of this transition is to turn off power amplifier 46, thereby shutting off current flow to primary coil 51, part of coil 50. This causes the spark energy to be produced in the coil secondary 52 when the magnetic field collapses in coil 50.

The Q bar output of flipflop 76 is also coupled to the D input (data) of flipflop 78, but flipflop 78 does not respond to this data at this instant because it has an invalid clock (non-active) state. The Q output of flipflop 76 goes to a "low" state to allow flipflop 78 to respond to the input data as soon as a "low"-to-"high" transition appears at its clock input. When the output of inverter 64 switches to the "high" state, the rising edge is felt by flipflop 78 clock input, and thus it clocks the "high" from the data input (which is connected to the Q bar output of flipflop 76), to its Q output which is, in turn, connected to the set input of flipflop 76 to promptly force flipflop 76 asynchronically to the set state (Q output "high", Q bar output "low"), thereby restoring current to the coil 50 as the power amplifier 46 is restored to the active current passing condition. Additionally the "low" at Q bar is felt at the D input to flipflop 78, and the "high" level of Q output of flipflop 76 will be felt by the reset input of flipflop 78, thus resetting it for the next pulse.

The state of flipflop 78 remains reset because, even though the Q bar output of flipflop 76 goes "high" causing the D input of flipflop 78 to go "high", the clock input of flipflop 78 remains "high". Also, the data to the D input of flipflop 76 remains at a "high" level. Therefore there is not change at the output of flipflop 78 because there is no "low"-to-"high" transistor. However, when the output of inverter 64 (the inverted output of light sensor 4) next goes "high", flipflop 78 is clocked causing its Q output to go "high" which sets flipflop 76.

When the Q bar output of flipflop 76 made its "low"-to-"high" transition, monostable flipflop 72, if provided, was triggered causing an output pulse to appear at its Q output 74. This pulse, the width of which is determined by selecting appropriate timing RC components, is applied to terminal 70 of switch 32 and therefore to and through NORgate 30 and to the succeeding circuitry. In this manner, a single pulse emulating the opening of a set of conventional points is obtained for use in the service mode. As previously mentioned, the output pulse from the Q bar output of flipflop 76 may be directly connected to the terminal 70 of switch 32 to obviate the necessity for the flipflop 72. For most applications, the "firing pulse" thus obtained is entirely satisfactory.

The output of inverter 64 is also applied to the input of another inverter 82 which has its output coupled to the base electrode of an NPN transistor 84 (e.g., a 2N2222). Transistor 84 has its emitter electrode connected to ground and its collector electrode coupled to a source of supply voltage (e.g., +12 volts d-c) via resistor 86, and an output 88 may be taken from the collector of transistor 84 to drive, for example, a conventional tachometer 17 or an on-board computer. Optionally, the output of inverter 64 may also be applied to trigger a second monostable flipflop 92 such that a "low"-to-"high" transition at the output of inverter 64 will cause counterpole pulses to be generated at the Q and Q bar outputs of the monostable flipflop 92. These output signals may be used by, for example, a diagnostic or an on-board comptuer.

It will be understood from the foregoing discussion that the manner in which a single pulse is developed in the service mode corresponds exactly in timing to the onset of a burst of pulses in the normal operating mode. Therefore, very precise ignition timing can be established in the service mode.

If it is desired to continuously apply firing pulses to the ignition coil 50 without regard to the angular position of the shutter 6, and thus emulate the Brodie system, the switch 68 may be thrown to its alternate position which leaves OR-gate 20 permanently enabled whereby frequency divider 25 continues to count without the periodic interruptions controlled by the light sensor 4. If this feature is not deemed desirable, switch 68 may simply be omitted.

Figure 3:
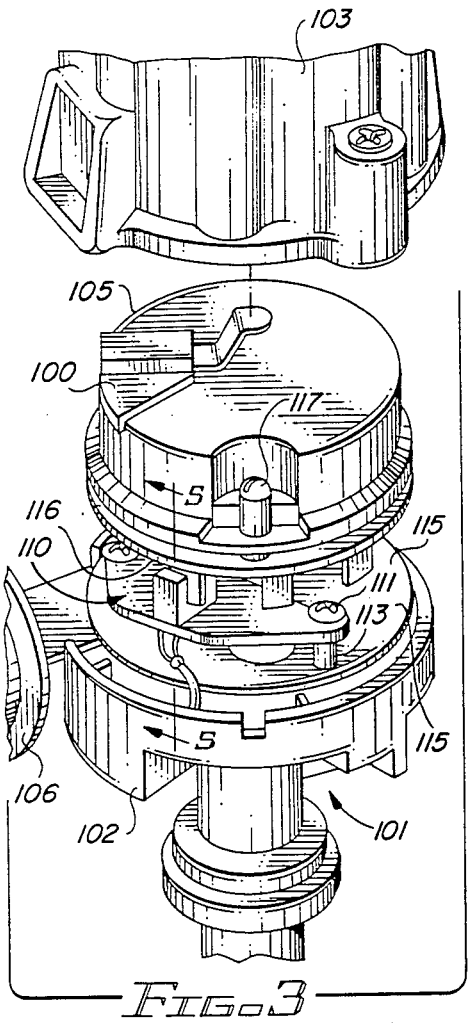
FIG. 3 is a partially exploded view of a conventional internal combustion engine distributor into which a preferred sensor assembly component of the subject ignition system has been incorporated.
Figure 4:
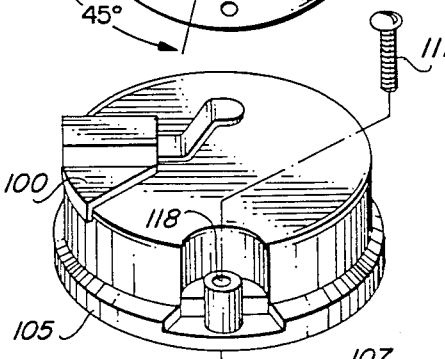
FIG. 4 is a more completely exploded view of the distributor more clearly depicting the sensor assembly and its relationship to the other distributor components.
Figure 4:
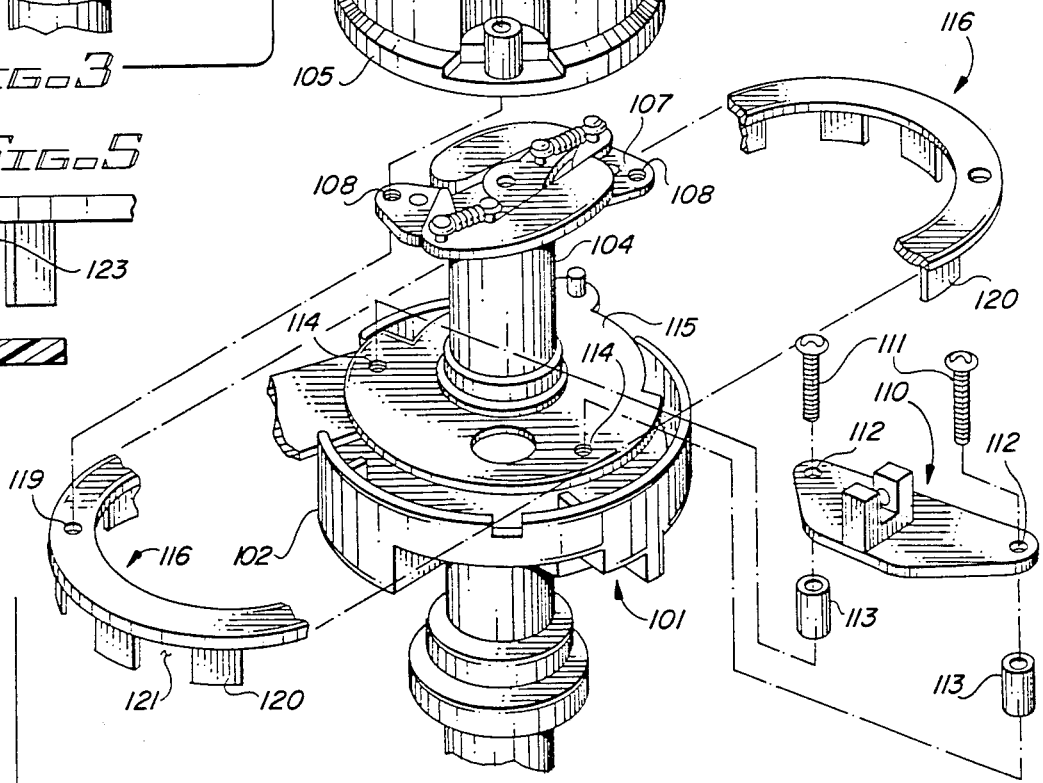

As previously mentioned, a feature of this invention is the fact that it can be readily integrated into existing internal combustion engine ignition systems as well as into new systems with or without a conventional distributor. FIGS. 3 and 4 illustrate the manner in which a light source/sensor assembly 110 may be incorporated into an existing internal combustion engine distributor to facilitate retrofitting the subject digital ignition system. Thus, a conventional distributor 101 includes a base 102 over which is fitted a cap 103 to enclose the rotating structure. A distributor shaft 104 extends downwardly into the engine and is geared to the engine to obtain and transmit instantaneous engine angular position information in the well known manner. A rotor 105 turns with the shaft 104 to distribute high tension energy to a series of circumferentially distributed electrodes within the cap 103, again in the well known manner, for distribution to the several engine spark plugs via spark plug wires (not shown) inserted into the top of distributor cap 103. Engine timing may be dynamically altered according to the response of vacuum advance unit 106 and centrifugal weights 107, again in the conventional and well known fashion. The electrode 100 carried by the rotor 105 may advantageously be "pie" shaped as shown to limit the resistance voltage drop across its length.

The distributor 101 does not employ breaker points to establish the instant at which a spark plug is energized but rather has been fitted, or retrofitted, with the light source/sensor assembly 110 which is the preferred firing coordination sensor for the present invention. More particularly, and also referring to FIG. 5, the light source/sensor assembly 110 is situated in the position normally occupied by a set of breaker points and is secured by screws 111 passing through apertures 112 and spacers 113 and turned into threaded apertures 114 provided in the distributor slide plate 115.

A circular shutter assembly 116 is positioned below the rotor 105 and the centrifugal weight structure 107, and these components rotate together with the distributor shaft 104. The circular shutter assembly 116 is secured in position beneath the centrifugal weight structure 107 by screws exemplified by the screw 117 passing through an aperture 118 through the outer edge of the rotor 105, through an aperture 108 in the centrifugal weight structure 107 and into a threaded hole 119 in the shutter assembly 116. One or more additional screws, not shown, are distributed around the rotor 105 to rigidly juxtapose the shutter assembly 116 to the underside of the centrifugal weight structure 107.

Figure 5:
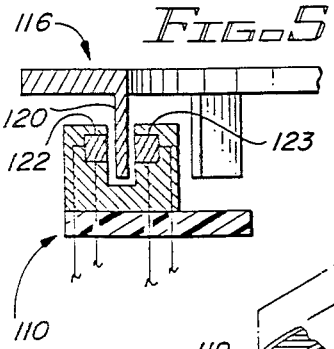
FIG. 5 is a partial cross sectional view taken along the lines 5—5 of FIG. 3 to particularly illustrate the manner in which timing signals are obtained to coordinate the operation of my ignition system by the cooperation of the sensor assembly and a rotating shutter assembly.

As best shown in FIGS. 4 and 5, the shutter assembly 116 includes downwardly extending lip segments 120 separated by spaces 121 disposed proximate the outer periphery of the shutter assembly. Referring specifically to FIG. 5, it will be seen that the light source/sensor assembly 110 includes light source 122, which corresponds to the light source 5 illustrated in FIGS. 1 and 2, and light sensor 123 which corresponds to the light sensor 4 illustrated in FIGS. 1 and 2. The mutual orientation of the light source/sensor assembly 110 and the shutter assembly 116 are such that the lip segments 120 extend downwardly into the space between the light source 122 and the light sensor 123 to cut off light communication therebetween. Thus, it will be understood that as successive lip segments 120 and spaces 121 alternately pass through this region, the light is correspondingly alternately passed and stopped to create a pulsating signal which is employed as the basic timing source in the ignition system as previously described during the discussion of FIGS. 1 and 2.

To those skilled in the art, it will be immediately apparent that the light source/light sensor method of extracting angular timing information is much more stable and precise than such other commonly used methods as reluctance coil (Hall effect) and magnet pole pieces, and points as well as the magneto type of ignition systems. The fundamental reason for this advantage is that the light source/light sensor is accurate at any speed from 0 RPM to the "red-line" speed of any given engine.

Figure 6:
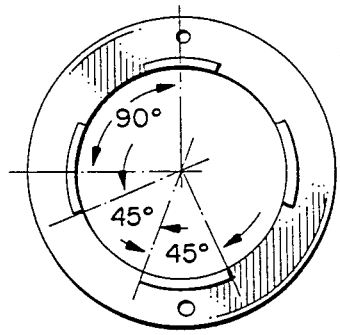
FIG. 6 illustrates an exemplary shutter assembly for a four cylinder engine employing the subject ignition system.
Figure 7:
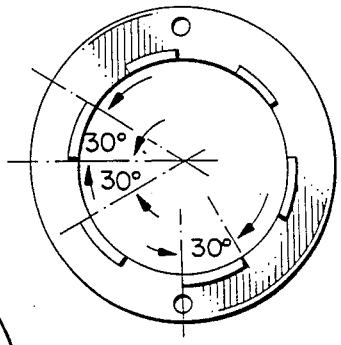
FIG. 7 illustrates an exemplary shutter assembly for a six cylinder engine employing the subject ignition system.
Figure 8:
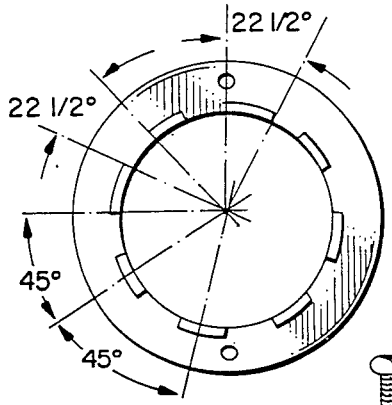
FIG. 8 illustrates an exemplary shutter assembly for an eight cylinder system employing the subject ignition system.

FIGS. 6, 7 and 8 are views from below of shutter assemblies **116*a*, 116*b*, and 116*c* which are, respectively, particularly adapted for 4, 6 and 8 cylinder engines. As shown in FIG. 6, four lip segments 120*a* are separated by four spaces 121*a*, and each lip and space occupies an angular forty-five degrees. Similarly, in FIG. 116*b* there are six lip segments 120*b* and six spaces 121*b*, each occupying a thirty degree segment. Finally, as shown in FIG. 8, each of eight lip segments 120*c* and eight spaces 121*c* occupy twenty-two and a half degrees arc. It will be appreciated from an examination of FIGS. 6, 7 and 8 that the pulses sensed by the light sensor 123 (i.e., the light sensor 4 in FIGS. 1 and 2) as a space 121 passes through the gap between the light source 122 and 123** results in gating the firing pulse stream to the ignition coil primary to provide continuous sparking throughout essentially the complete power stroke of a given cylinder. That is, if the ignition timing is set to top dead center, the spark plugs fires continually throughout the entire power downstroke of the piston in the cylinder, and if the initial timing is adjusted a little before or after top dead center, the spark plug correspondingly continues to fire until just a little before or after bottom dead center.

It will be appreciated that the lip segments 120 and the space segments 121 need not occupy equal angles. If desired, the angular scope of the lip segments may be increased or decreased in order to fire each spark plug for more or less than the full power stroke of a cylinder.

While the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. A spark ignition system for an internal combustion engine comprising:

(A) a free running source of equally time-spaced pulses which periodically switch between logic "high" and logic "low" levels;

(B) engine angular position sensing means for generating an engine timing signal characterized by the presence of a first logic level when the engine angular position is within a first angular range and by the presence of a second logic level when the engine angular position is within a second angular range which does not include said first angular range, said first engine angular position corresponding to at least a portion of an engine cylinder power stroke;

(C) a triggerable source of intermittent high voltage pulses, said triggerable source having an output delivering a single high voltage single-polarity pulse each time it is triggered, said triggerable source comprising an ignition coil including a single-ended low voltage primary winding and a high voltage secondary winding;

(D) trigger signal developing means having an input and an output, said trigger signal developing means output being connected to said triggerable source and adapted to trigger said triggerable source in response to the transition of a signal between logic "low" and logic "high" appearing at said input to said trigger signal developing means, said trigger signal developing means including an electronic switch disposed in series with said ignition coil primary winding and a d-c electrical power source such that, when said electronic switch is closed, current from said power source passes through said primary winding to generate a magnetic field and when said electronic switch is opened, the magnetic field collapses to induce a high voltage pulse in said secondary winding;

(E) gating means responsive to the presence of said first logic level in said timing signal to pass said equally time-spaced pulses to said input of said trigger signal developing means and to the presence of said second logic level in said engine timing signal to prevent said equally time-spaced pulses from being applied to said input of said trigger signal developing means;

(F) frequency determining means included in said free running source, said frequency determining means being set to establish the frequency of said equally time-spaced pulses to a frequency at which said ignition coil fully saturates during each period in which said electronic switch is closed such that said triggerable source delivers successive equal and full amplitude equally time-spaced high voltage pulses in response to successive equally time-spaced pulses applied to said gating means, all said pulses being of single and like polarity; and (G) high voltage distribution means for transferring a continuous train of equally time-spaced, full amplitude high voltage pulses generated by said triggerable source to a spark plug in the cylinder to be fired during the entire period when said engine angular position sensing means senses that the instantaneous engine angular position falls within said first angular range.

2. The ignition system of claim 1 in which said engine angular position sensing means comprises:

(A) a shaft rotating at a rate directly proportional to engine speed;

(B) a circular shutter assembly coaxially disposed with respect to said shaft and rotating therewith, said shutter assembly having a peripheral region characterized by circumferentially arranged alternating segments and spaces;

(C) a light sensor;

(D) a light source spaced from and directed toward said light sensor; and (E) means fixing the positions of said light sensor and said light source with respect to one another and with respect to said shutter assembly such that said peripheral region of said shutter assembly extends into the space between said light source and said light sensor thereby alternating blocking and passing light from said light source to said light sensor as said shutter assembly rotates with said shaft.

3. The ignition system of claim 1 in which said free running source of equally time-spaced pulses comprises:

(A) a free running oscillator issuing a continuous stream of clock pulses; and (B) a digital frequency divider connected to receive said equally time-spaced clock pulses from said oscillator and adapted to respond thereto by issuing a single frequency-divided pulse each time a predetermined number of said equally time-spaced clock pulses has been received such that the time period between the onset of successive frequency-divided pulses is constant and a stream of said frequency-divided pulses constitutes said equally time-spaced pulses.

4. The ignition system of claim 2 in which said free running source of equally time-spaced pulses comprises:

(A) a free running oscillator issuing a continuous stream of clock pulses; and (B) a digital frequency divider connected to receive said equally time-spaced clock pulses from said oscillator and adapted to respond thereto by issuing a single frequency-divided pulse each time a predetermined number of said equally time-spaced clock pulses has been received such that the time period between the onset of successive frequency-divided pulses is constant and a stream of said frequency-divided pulses constitutes said equally time-spaced pulses.

* * * * *